US006060958A

United States Patent [19]

Tokudera et al.

[11] Patent Number: 6,060,958

[45] Date of Patent: May 9, 2000

[54] NONRECIPROCAL CIRCUIT DEVICE HAVING CHAMFERED OR TAPERED YOKE SIDE WALLS

[75] Inventors: Hiromu Tokudera; Yutaka Ishiura, both of Nagaokakyo, Japan

[73] Assignee: Murata Manufacturing Co., Ltd., Japan

[21] Appl. No.: 09/204,935

[22] Filed: Dec. 3, 1998

[30] Foreign Application Priority Data

Dec. 4, 1997 [JP] Japan ..... 9-334442

[51] Int. Cl.[7] ..... H01P 1/383

[52] U.S. Cl. ..... 333/1.1; 174/52.6; 220/4.02; 220/4.21; 220/DIG. 25

[58] Field of Search ..... 333/1.1, 24.2, 333/99 R; 174/52.5, 52.6; 334/85; 336/90; 220/4.02, 4.21, 796, 799, DIG. 25

[56] References Cited

U.S. PATENT DOCUMENTS 4,948,947 8/1990 Kang ..... 220/DIG. 25

5,159,294 10/1992 Ishikawa et al. ..... 333/1.1

5,398,169 3/1995 Gorenz, Jr. et al. ..... 334/85 X 5,531,345 7/1996 Nakamura et al. ..... 220/4.21 X

*Primary Examiner*—Paul Gensler

*Attorney, Agent, or Firm*—Ostrolenk, Faber, Gerb & Soffen, LLP

[57] ABSTRACT

A nonreciprocal circuit device wherein upper and lower yokes can easily be fitted together, thereby preventing the deviation between the upper and lower yokes to obtain excellent electric characteristics. The upper yoke is bent in a box shape, and provided with an upper wall and two pairs of side walls of approximately rectangular shape, a lower yoke is bent in a U-shape, and provided with a bottom wall and a pair of side walls opposite to each other. A chamfer and a taper continuous to the chamfer are executed on each end face of a lapped part of the side wall on side walls of the upper yoke. Moreover, a perpendicular part parallel to the upper yoke side wall is formed on a lapped part on the upper yoke side wall.

3 Claims, 4 Drawing Sheets

NONRECIPROCAL CIRCUIT DEVICE HAVING CHAMFERED OR TAPERED YOKE SIDE WALLS

BACKGROUND OF THE INVENTION

1. Field of the Invention

The present invention relates to a nonreciprocal circuit device to be used in a high frequency band such as the microwave band, for example, an isolator or a circulator.

2. Description of the Related Art

Such an isolator is conventionally of the structure illustrated in FIG. 5 and FIG. 6. FIG. 5 is an exploded perspective view of the isolator, and FIG. 6 is a sectional view illustrating a fitting part of an upper yoke and a lower yoke.

In the isolator, a permanent magnet 3 is attached to an inner surface of a box-shaped upper yoke 12 as illustrated in FIG. 5 and FIG. 6, a U-shaped lower yoke 18 is mounted to form a magnetic circuit, a resin case 7 is arranged on a bottom wall 18*a* of the lower yoke 18. A magnetic assembly 5 in which three central conductors 51–53 are arranged with a ferrite 54, matching capacitors C1–C3, and a terminating resistor R are arranged in the resin case 7.

The upper yoke 12 and the lower yoke 18 are integratedly formed by punching a metallic sheet of a predetermined thickness consisting of magnetic metal, and respectively executing steps of bending, drawing, etc., to constitute a magnetic circuit forming the contour of the isolator and to play a role to protect the respective parts arranged in the magnetic circuit to be constituted by the upper and lower yokes 12, 18.

The upper yoke 12 is bent in a box-shape, and provided with an upper wall 12*a* and two pairs of side walls 12*b*, 12*c*, while the lower yoke 18 is bent in a U-shape, and provided with a bottom wall 18*a* and one pair of side walls 18*b*. Both end parts of a pair of side walls 12*c* opposite to each other of the upper yoke 12 form guide parts 12*d*, which project by a distance approximately equal to the thickness of the lower yoke side wall 18*b* from the outer surface of the side wall 12*b*. The guide part 12*d* plays a role to prevent the deviation in the horizontal direction (the direction of the arrow A in FIG. 6) of the lower yoke 18.

In the upper yoke 12 and the lower yoke 18, both end faces 18*c* of the lower yoke side wall 18*b* are lapped and fitted to each other along the guide part 12*d* of the upper yoke side wall 12*c* so that the surface of the upper yoke side wall 12*b* is brought into contact with the surface of the lower yoke side wall 18*b*, and the fitted parts are connected and fixed to each other by soldering.

The resin case 7 consists of a resin material with heat resistance and electric insulation. A side wall of rectangular frame shape is integrated with a bottom wall, input/output terminals 71,72, and ground terminals 73,73 are provided at predetermined positions, and the above-mentioned members of the isolator and the upper and lower yokes 12,18 are stably arranged and positioned.

In a nonreciprocal circuit device, any positional deviation of the yoke which constitutes the magnetic circuit adversely affects the electric characteristics. That is, when the upper and lower yokes are connected in a deviated position, the symmetry of the magnetic field distribution to be applied to a magnetic assembly is damaged by the deviation, and the electric characteristics such as isolation and insertion loss are degraded. Miniaturization of the mobile communication equipment in which this type of the nonreciprocal circuit device is employed has been rapidly developed, and further miniaturization of the nonreciprocal circuit device is strongly requested. In a recently miniaturized nonreciprocal circuit device (for example, 7.0 mm in length and width, and 2.5 mm in height), the deviation of the upper and lower yokes is required to be 0.1 mm or less from the electric and magnetic viewpoints.

However, in the conventional isolator, lapped parts of the guide part 12*d* of the upper yoke side wall 12*c* with both end faces 18*c* of the lower yoke side wall 18*b* are parallel surfaces to each other, and there has been a problem that the fitting work (assembly) becomes difficult if the clearance (gap) S between the guide part 12*d* of the upper yoke 12 and the end face 18*c* of the lower yoke side wall 18*b* is reduced in order to suppress the deviation of the lower yoke 18 in the horizontal direction. When the isolator is assembled by an automatic machine, a clearance S of not less than 0.1 mm is necessary for the automatic machine in the present situation, and the clearance S between the upper and lower yokes can not be set to be 0.1 mm or less.

SUMMARY OF THE INVENTION

The present invention provides a nonreciprocal circuit device in which the upper and lower yokes can easily be fitted together, thereby preventing deviation between the upper and lower yokes and thereby obtaining excellent electric characteristics.

According to an aspect of the invention, the end faces of an upper yoke side wall and a lower yoke side wall are chamfered or tapered in a nonreciprocal circuit device where the upper yoke having at least a pair of side walls opposite to each other and the lower yoke having at least a pair of side walls opposite to each other are fitted to form a magnetic circuit so that the upper yoke side walls and the lower yoke side walls are orthogonal to each other at the respective end parts, and a magnetic assembly and a permanent magnet are stored in the magnetic circuit.

According to another aspect of the invention, the lower yoke side walls or the upper yoke side walls are chamfered by 0.1 mm or more, and tapered by 1.0 mm or more in length and 0.05 mm or more in width continuous to the chamfer in the nonreciprocal circuit device.

In such a construction, the end faces of the lower yoke side walls or the upper yoke side walls are chamfered or tapered, and the upper yoke can be fitted to the lower yoke in an extremely easy manner even when the clearance between the upper yoke side walls and the lower yoke side walls is reduced. That is, the man-hours required for assembly can be reduced, and the deviation between the upper and lower yokes can be prevented.

If the chamfer is executed together with the taper, the deviation between the upper and lower yokes can be prevented even more effectively. The chamfering dimension is preferably not less than 0.1 mm, and the taper to be continuously executed to the chamfer is preferably not less than 1.0 mm in length and not less than 0.05 mm in width.

Other features and advantages of the invention will be understood from the following description of embodiments thereof, in which like references indicate like elements and parts.

DESCRIPTION OF AN EMBODIMENT OF THE INVENTION

The present invention is described with reference to the drawings illustrating an embodiment of the invention.

Figure 1:
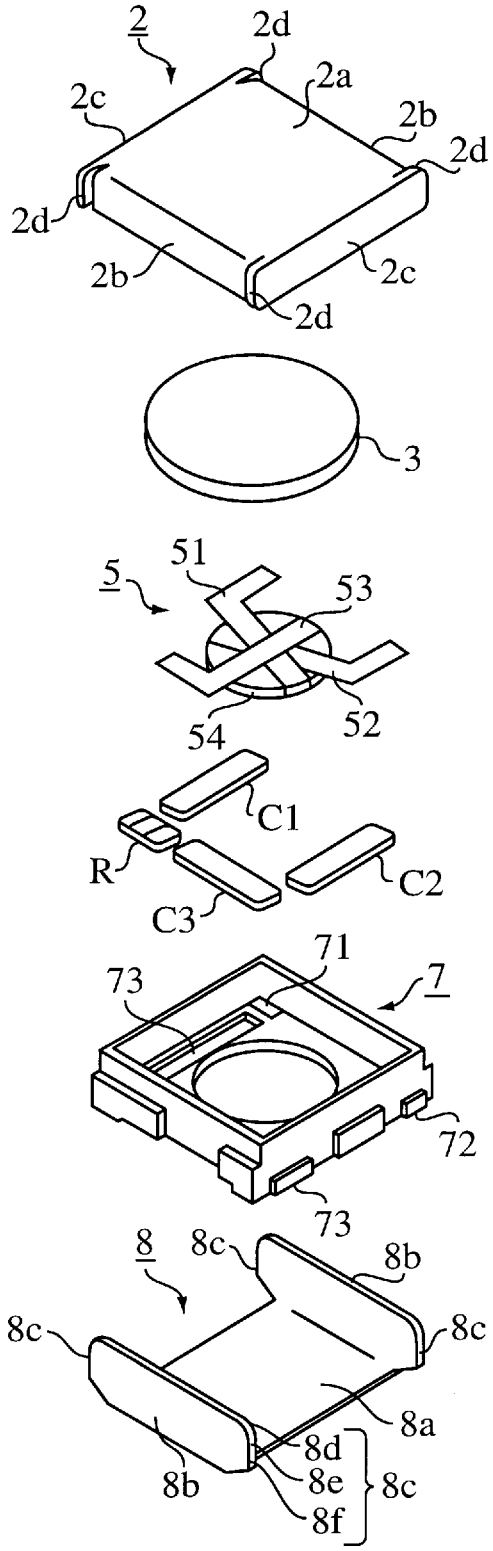
FIG. 1 is an exploded perspective view of an isolator of one embodiment of the present invention.
Figure 2:
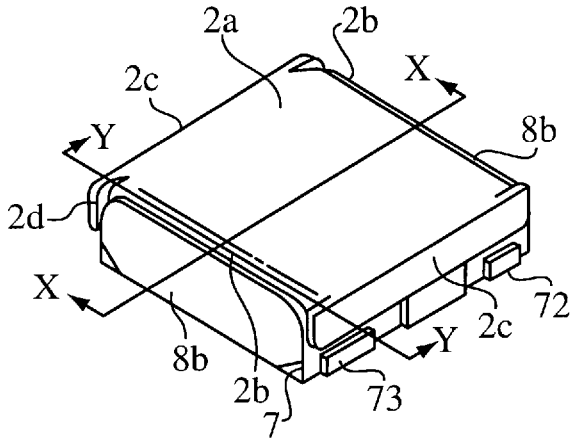
FIG. 2 is a perspective view of the isolator of the embodiment of the present invention.
Figure 3:
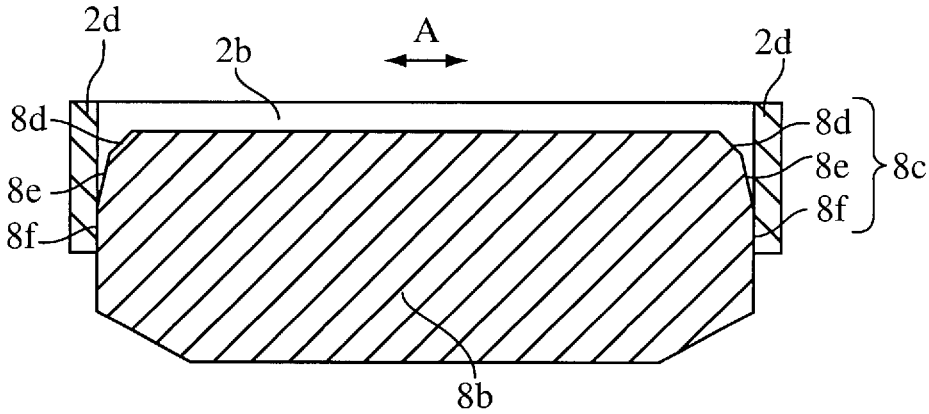
FIG. 3 is a sectional view taken along the line Y—Y in FIG. 2.
Figure 4:
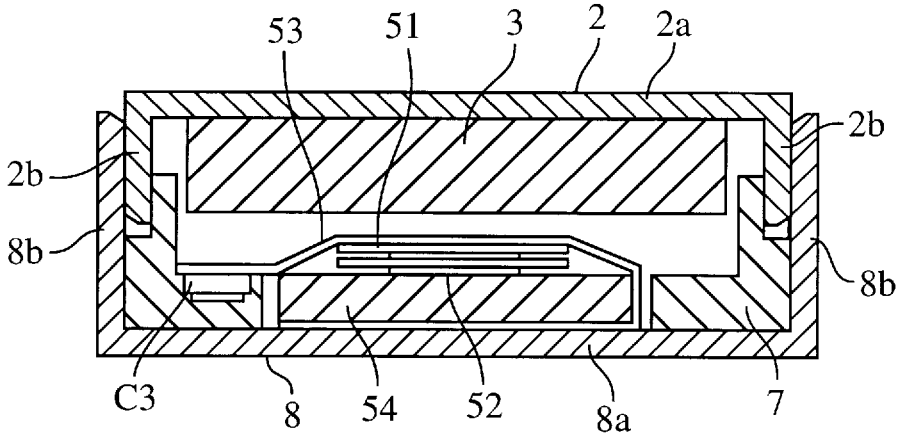
FIG. 4 is a sectional view taken along the line X—X in FIG. 2.
Figure 5:
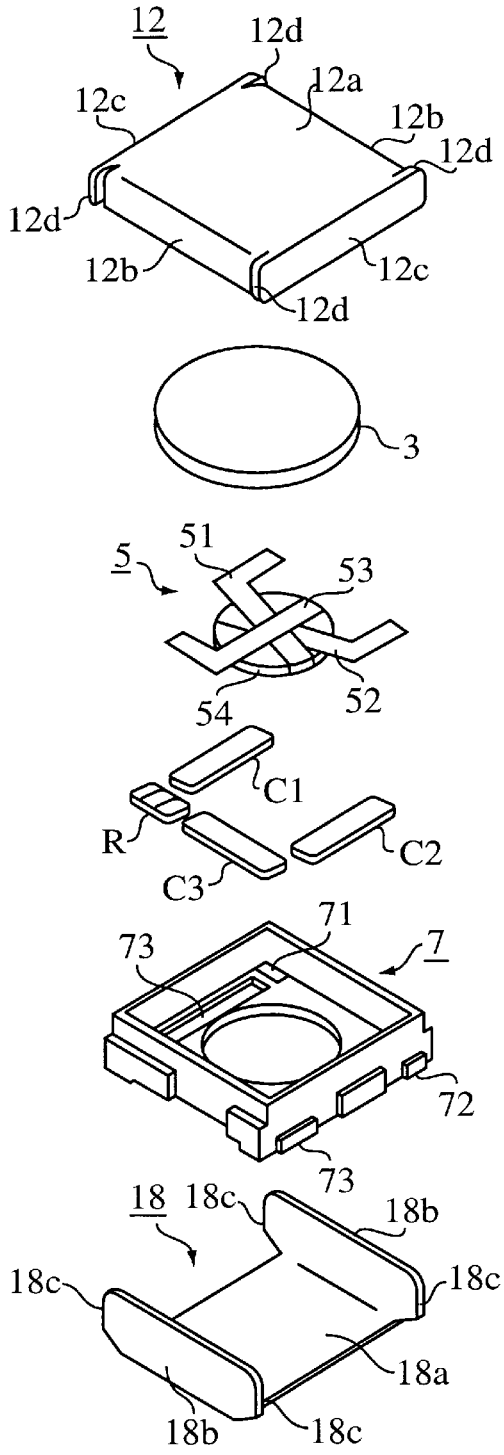
FIG. 5 PRIOR ART
FIG. 5 is an exploded perspective view of a conventional isolator.
Figure 6:
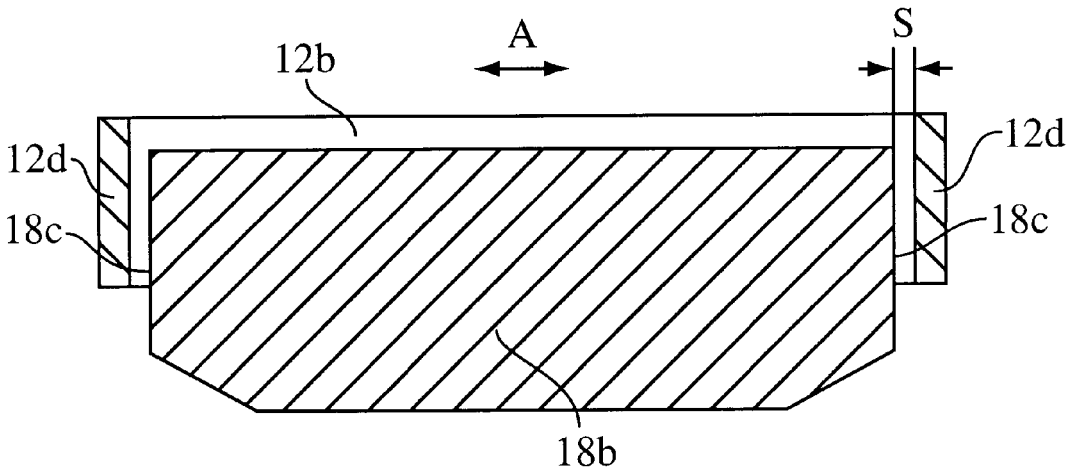
FIG. 6 PRIOR ART
FIG. 6 is a sectional view of the conventional isolator.

The construction of the isolator of the embodiment of the present invention is shown in FIG. 1 through FIG. 4. FIG. 1 is an exploded perspective view of the isolator, FIG. 2 is a perspective view, FIG. 3 is a sectional view taken along the line Y—Y in FIG. 2, FIG. 4 is a sectional view taken along the line X—X in FIG. 2. FIG. 3 shows only the upper and lower yokes.

In the isolator of the embodiment, as shown in FIG. 1 to FIG. 4, a permanent magnet 3 is attached to an inner surface of a box-shaped upper yoke 2, and a U-shaped lower yoke 8 is mounted thereon to form a magnetic circuit, a resin case 7 is arranged on a bottom wall 8*a* of the lower yoke 8, a magnetic assembly 5, matching capacitors C1–C3, and a terminating resistor R are arranged in the resin case 7, and the DC magnetic field is applied to the magnetic assembly 5 by the permanent magnet 3.

The upper yoke 2 and lower yoke 8 are integratedly formed by punching a metallic sheet having predetermined thickness consisting of a magnetic metal, and executing steps of bending, drawing, etc., respectively, to constitute a magnetic circuit to form the contour of the isolator, and to play a role to protect the respective parts to be arranged in the magnetic circuit comprising the upper and lower yokes 2,8.

The upper yoke 2 is bent in a box shape, and provided with an upper wall 2*a* of approximately rectangular shape and two pairs of side walls 2*b*,2*c*, while the lower yoke 8 is bent in a U-shape, and provided with a bottom wall 8*a* and a pair of side walls 8*b* opposite to each other. Both end parts of one pair of side walls 2*c* of the upper yoke 2 form guide parts 2*d* which project by a distance approximately equal to the thickness of the side wall 8*b* of the lower yoke 8 from the outer surface of the other pair of side walls 2*b*. The guide part 2*d* plays a role to prevent the deviation of the lower yoke 8 in the horizontal direction (the direction of the arrow A in FIG. 3).

In the lower yoke 8 of the embodiment, a chamfer 8*d* and a taper 8*e* continuous to the chamfer 8*d* are formed on each end face 8*c* of the lapped part of the side wall 8*b* on the side walls 2*b*,2*c* of the upper yoke 2. A perpendicular part 8*f* parallel to the upper yoke side wall 2*c* is formed on a lapped part on the upper yoke side wall 2*c*. The perpendicular part 8*f* is formed to be continuous to the taper 8*e*. Regarding the dimension of the chamfer 8*d* or the taper 8*e*, the distance between an upper end face of the chamfer 8*d* part and the upper yoke side wall 2*c* (the guide part 2*d*) is set taking into consideration the dimensional tolerance in manufacturing the yoke so that the fitting work is facilitated. The dimension between the perpendicular parts 8*f* of the lower yoke 8 is set so as to be within the allowable range of the change in the electric characteristics caused by the deviation between the upper yoke 2 and the lower yoke 8.

The isolator of the embodiment is 7.0 mm in length and width, and 2.5 mm in height, and formed of a magnetic metal sheet of 0.2 mm in thickness, chamfered by 0.2 mm, and tapered by 1.0 mm in length in the perpendicular direction and 0.05 mm in width in the horizontal direction. The dimension or distance between the perpendicular parts 8*f* of both end faces 8*c*, parallel to the upper yoke side walls 2*c*, is set to be the same as the dimension or distance between the upper yoke side walls 2*c* (guide parts 2*d*). The dimensional setting causes no inconveniences in fitting in the present automatic assembling machine.

In the upper yoke 2 and the lower yoke 8, both end faces 8*c* of the lower yoke side walls 8*b* are lapped and fitted along the guide part 2*d* of the upper yoke side walls 2*c* so that the surface of the upper yoke side wall 2*b* is brought into contact with the surface of the lower yoke side wall 8*b*, and the fitted parts are connected and fixed to each other by soldering, and mounted.

In the magnetic assembly 5, ground portions of three central conductors 51–53 formed of the metallic sheet are abutted on the lower surface of a disk-shaped ferrite 54, and the three central conductors 51–53 are bent so as to form the angle of 120° from each other with an insulation sheet interposed therebetween, and arranged on the upper surface of the ferrite 54. The magnetic assembly is not limited to this structure, but may be of the structure where the central conductors are formed in a laminated ceramic, or the central conductors are formed in a laminated magnetic body for example.

The resin case 7 is formed of the resin material with heat resistance and electric insulation, and of the structure where the bottom wall is integrated with the side walls of rectangular frame shape, and input/output terminals 71, 72 and ground terminals 73, 73 are molded at the predetermined positions, and insertion holes to arrange the magnetic assembly 5 and recessed portions to store the capacitors and resistors are formed in the bottom wall. The resin case 7 is of the structure in which the above-mentioned members of the isolator, the upper and lower yokes 2,8 are stably arranged and positioned.

In the isolator of the present embodiment, the chamfer 8*d* and the taper 8*e* continuous to the chamfer 8*d* are formed on each end face 8*c* of the lower yoke side wall 8*b*. The lower yoke side walls 8*b* orthogonal to the upper yoke side walls 2*c* are smoothly fitted to the guide part 2*d* of the upper yoke side wall 2*c*. Therefore, the fitting work of the upper yoke 2 to the lower yoke 8 can be executed in an extremely easy manner. In a condition where the upper yoke 2 and the lower yoke 8 are mounted, the perpendicular part 8*f* of each end face 8*c* of the lower yoke side wall 8*b* and the upper yoke guide part 2*d* are closely mounted, and no deviation in the horizontal direction between the upper yoke 2 and the lower yoke 8 is generated.

When the constitution of the present embodiment is adopted, the deviation between the upper yoke and the lower yoke can be prevented even if the side walls of the resin case 7 are reduced in thickness or the side walls are dispensed with, and thus, the dimensional accuracy of positioning the upper and lower yokes of the resin case 7 can be improved, and the cost of the resin case can be reduced, and the resin case can be further miniaturized.

In the present embodiment, in order to easily fit the upper yoke side wall 2*b* to the lower yoke side wall 8*b*, the lower outer side part of the upper yoke side wall 2*b* and the upper inner side part of the lower yoke side wall 8*b* are chamfered as indicated in FIG. 4. If the lower inner side part of the guide part 2*d* of the upper yoke side wall 2*c* is chamfered, though it is not shown in the figure, the upper yoke 2 and the lower yoke 8 can be more easily fitted to each other.

In the above-mentioned embodiment, the case where the lower yoke is both chamfered and tapered is described, but the embodiment is not limited thereto, and either the chamfer or the taper may be executed. The present invention includes the chamfer comprising a curved surface (R). Contrary to the above-mentioned embodiment, the upper yoke side wall may be fitted to the lower yoke side walls, and in this case, the end faces of the upper yoke side walls are chamfered or tapered.

Further, in the above-mentioned embodiment, the isolator is described as an example, but the present invention can be applied to a circulator having three input/output parts without connecting the terminating resistor R.

As described above, in the nonreciprocal circuit device, the end faces of the lower yoke side walls or the upper yoke side walls are chamfered or tapered, and the upper yoke can be fitted to the lower yoke in an extremely easy manner even when the clearance between the upper yoke side wall and the lower yoke side wall is reduced. Thus, the assembly man-hours can be reduced, the deviation between the upper and lower yokes can be prevented, and a nonreciprocal circuit device which is inexpensive and excellent in electric characteristics can be obtained.

Although an embodiment of the invention has been described, the invention is not limited to this embodiment, but rather includes all modifications and variations that would occur to one having ordinary skill in the pertinent art.

What is claimed is:

1. A nonreciprocal circuit device wherein:

an upper yoke having at least one pair of side walls opposite to each other is fitted to a lower yoke having at least one pair of side walls opposite to each other so that an upper yoke side wall and a lower yoke side wall are orthogonal to each other to form a magnetic circuit, and a magnetic assembly and a permanent magnet are disposed in said magnetic circuit, wherein end faces of at least one of the lower yoke side walls and the upper yoke side wall are chamfered or tapered.

2. A nonreciprocal circuit device according to claim 1, wherein a chamfer of at least 0.1 mm and a taper of at least 1.0 mm in length and at least 0.05 mm in width continuous to the chamfer are formed on said at least one of the lower yoke side walls and the upper yoke side wall.

3. A nonreciprocal circuit device according to claim 1, wherein said end faces of said at least one of the lower yoke side walls and the upper yoke side walls are chamfered as well as tapered.

* * * * *